US006312076B1

(12) United States Patent
Taki et al.

(10) Patent No.: US 6,312,076 B1
(45) Date of Patent: Nov. 6, 2001

(54) DRIVING WAVEFORM GENERATING DEVICE AND METHOD FOR INK-JET RECORDING HEAD

(75) Inventors: Hideo Taki; Shuji Otsuka, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/073,766

(22) Filed: May 7, 1998

(30) Foreign Application Priority Data

May 7, 1997 (JP) ..... 9-117322
Apr. 15, 1998 (JP) ..... 10-104970

(51) Int. Cl.[7] ..... B41J 29/38; B41J 2/205; B41J 2/165

(52) U.S. Cl. ..... 347/10; 347/12; 347/11; 347/15; 347/14; 347/23

(58) Field of Search ..... 347/12, 9, 10, 347/15, 11, 57, 55, 58, 59, 181, 182, 142, 145, 14, 23; 400/64, 70, 76, 74

(56) References Cited

U.S. PATENT DOCUMENTS 3,769,631 * 10/1973 Hill et al. ..... 347/10
5,477,245 * 12/1995 Fuse ..... 347/10
5,521,619 * 5/1996 Suzuki et al. ..... 347/10

* cited by examiner

*Primary Examiner*—John Barlow
*Assistant Examiner*—Charles W. Stewart, Jr.
(74) *Attorney, Agent, or Firm*—Sughrue, Mion, Zinn Macpeak & Seas, PLLC

(57) ABSTRACT

A driving waveform generating device and method comprises the steps of retaining data on absolute coordinate values in a waveform data storage unit 1 as data at a plurality of points in a plurality of driving waveforms a–f at a predetermined temperature, reading the data on the plurality of point in a desired driving waveform a from a waveform data read unit 3A on the basis of gradation data, correcting the difference between the environmental temperature during the printing operation and the aforesaid predetermined temperature in a temperature compensation unit 3B, converting data on the corrected absolute coordinate value to data on the relative coordinate value in waveform data conversion unit 3C, interpolating the point-to-point value by means of a waveform data interpolation unit 5, subjecting the interpolated the data on the driving waveform to analog conversion by means of a D/A conversion unit 7, amplifying the analog signal in a signal amplifier unit 9, and outputting the amplified signal.

23 Claims, 12 Drawing Sheets

DRIVING WAVEFORM GENERATING DEVICE AND METHOD FOR INK-JET RECORDING HEAD

BACKGROUND OF THE INVENTION

Field of the Invention

The present invention relates to a driving waveform generating device and a driving waveform generating method for an ink-jet recording head capable of forming dots different in gradation value by driving the recording head according to gradation data, and more particularly to a driving waveform generating device and a driving waveform generating method for an ink-jet recording head capable of generating driving waveforms in a programmable fashion by only changing coordinate data to be prestored.

Related Art

A typical ink-jet printer has a recording head with many nozzles in the subscanning direction (vertical direction) and while paper is fed as designated, the recording head is moved by a carriage mechanism in the main scanning direction (horizontal direction) in order to obtain desired print results. An ink drop is discharged from each nozzle of the recording head at predetermined timing according to dot pattern data resulting from developing the print data fed from a host computer, and the data is printed when the ink drops land on and stick to a print recording medium such as printing paper. Since the ink-jet printer is designed to discharge ink drops or stop to discharge them, that is, designed to control the on-off of dots, it is incapable of directly producing a print output in halftone; namely, gray color and the like. In consequence, there have heretofore been adopted a method of realizing halftone by expressing one pixel with a plurality of dots such as 4×4, 8×8 and so forth, a technique of increasing the gradient by causing one nozzle to discharge ink drops different in weight dot by dot so as to variably control the dot diameter on printing paper. In order to cause one and the same nozzle to discharge a plurality of ink drops different in weight, it is needed to vary the driving waveform of the head accordingly.

In a conventional driving waveform generating method for an ink-jet recording head, a circuit constituted of a hybrid IC, for example, has been employed so that a desired driving waveform is generated by putting an electric charge in and out of a pressure generating element (piezoelectric vibrator) forming the output side of a head driving circuit in the pulse width modulation (PWM) system (charge pump system).

FIGS. 13 (*a*), (*b*) are conceptual drawings of a conventional head driving circuit and the driving waveform formed thereby.

As show in FIG. 13 (*a*), the conventional head driving circuit is such that a piezoelectric vibrator C for discharging ink drops by displacing itself on receiving voltage forms a capacitor on the output side and is also connected to resistors R1–R6 different in resistance value. The connections of the piezoelectric vibrator C to the resistors R1–R6 are switched by transistors, respectively. The ON/OFF of these transistors are controlled by pulses in the aforesaid PWM system.

With respect to the driving waveform thus generated, the voltage is, as shown in FIG. 13(*b*), determined by the ON time (pulse width in the PWM system) of each transistor, and its inclination is determined by the CR constant at eth connection of each of the resistors R1–R6 to the aforesaid piezoelectric vibrator C.

In the aforesaid driving waveform generating method using the PWM system, however, the use of a complicated timing pulse is required to obtain the desired waveform.

As obvious from FIG. 13(*a*), moreover, there has existed a great deal of trouble for regulating timing with respect to variations in component elements such as the resistors R1–R6. In order to obtain more gradation expressions now, it has been attempted to multivalue dots. However, the driving waveform tends to become more complicated if such multivalued dots are employed and this makes it difficult to deal with such a driving waveform in the conventional driving waveform generating system.

SUMMARY OF THE INVENTION

An object of the present invention made in view of various problems posed as stated above is to provide a driving waveform generating device and method for an ink-jet recording head so that a desired programmable driving waveform is obtainable through a simple operation.

Another object of the present invention is to provide a driving waveform generating device and method for obtaining many complicated driving waveforms to make it possible to acquire more gradation expressions.

In order to accomplish the objects above, a driving waveform generating device for an ink-jet recording head according to the present invention for use in retaining a group of waveform data for generating driving waveforms beforehand, selecting and reading at least one waveform data to be utilized out of the group of waveform data, subjecting the read waveform data to a predetermined arithmetic process in order to create the driving waveform, subjecting the signal with the driving waveform to D/A conversion, amplifying and outputting the converted signal.

According to the present invention, a driving waveform generating device for an ink-jet recording head, the driving waveform generating device generating at least one presumed driving waveform in order to drive the recording head according to gradation data by utilizing the driving waveform, the driving waveform generating device comprising: waveform data storage means having a group of coordinate data for generating the driving waveform; waveform data read means for selecting at least one utilizing waveform data from the waveforms and reading the group of coordinate data for the driving waveform; waveform data interpolation means for creating the driving waveform by interpolating point-to-point values into the group of coordinate data read by the waveform data read means; digital/analog conversion means for subjecting data on the driving waveform created by the waveform data interpolation means to digital/analog conversion in order to output an analog signal; and signal amplification means for amplifying the analog signal which has been output from the digital/analog conversion means.

The group of coordinate data for generating driving waveforms are retained beforehand, and the group of coordinate data on the driving waveform to be utilized according to the gradation data are read out and employed. Therefore, the programmable driving waveform can be generating only by changing the group of coordinate data retained beforehand. Since the point-to-point values are interpolated in the group of coordinate data, the creation of the driving waveform can be made possible. The interpolated coordinate data is subjected to the D/A conversion. The signal subjected to the D/A conversion is amplified up to the level at which it is capable of driving the head, and the desired programmable driving waveform is obtainable through the simple operation, whereby the predetermined driving waveform in the form of a complete shape can be generated.

According to the present invention, a plurality of groups of coordinate data are prepared; any one of the groups of coordinate data are read; and a proper driving waveform corresponding to the gradation data is created so as to drive the recording head by utilizing the driving waveform.

According to the present invention, one driving waveform is created by reading out the group of coordinate data; and parts of the driving waveform are selectively utilized so as drive the recording head according to the gradation data.

According to the present invention, the driving waveform corresponding to the gradation data is created properly by selectively reading parts of the group of coordinate data so as to drive the recording head by utilizing the driving waveform.

According to the present invention, in the case of a gradation for forming dots by utilizing the driving waveform, a trapezoidal wave is contained in a driving waveform to be created.

According to the present invention, in the case of a gradation without forming dots by utilizing the driving waveform, a driving waveform to be generated is linear.

According to the present invention, the driving waveform generating device further comprises compensation means for correcting the coordinate data in consideration of ink condition during a printing operation.

Therefore, the desired driving waveform can be generated correctly because the coordinate data is corrected in consideration of the ink condition during the printing operation even when there occurs the difference in the environmental condition between the group of prestored coordinate data for generating the driving waveform and the actual printing operation.

According to the present invention, the ink condition is taken into consideration during the printing operation based on at least environmental temperatures.

Therefore, even though the environmental temperature during the printing operation differs from the temperature at the time the driving waveform is presumed, the desired driving waveform fit for use in the environmental temperature can be generated.

According to the present invention, the ink condition is taken into consideration during the printing operation based on at least environmental humidity.

According to the present invention, the signal amplification means comprises an amplifier circuit including a pair of transistors whose mutual emitters are connected together, and fixed resistors for always applying a predetermined voltage between the base emitter to make the pair of transistors operate in an active area; and a negative resistor element having the same resistance value as that of the fixed resistor is connected in parallel to by-pass the fixed resistor at a reference temperature before the pair of transistors self-generate heat so as to decrease the voltage between the base emitter when the voltage between the base emitter. rises because of the self-generation of heat on the part of the pair of transistors.

While the waveform is amplified in an extremely short time by operating the transistor in the active area, the negative resistance element is used for lowering the resistance value even though the self-generation of the transistor occurs to reduce the voltage between the base emitter, whereby the thermal runaway of the transistor is prevented.

A thermistor may be employed as the aforesaid negative resistance element.

According to the present invention, while a group of data on partial waveforms for generating driving waveforms are retained, a plurality of partial utilizing driving waveforms in are selected from the group of data on the partial waveforms in order to create a driving waveform by combining the partial waveforms.

A programmable driving waveform may be generated by changing the group of data on the partial waveforms to be retained beforehand or by selecting some of them or otherwise changing the way of combining them.

BRIEF DESCRIPTION OF THE DRAWINGS

FIG. 5 (*a*) and (*b*) a diagram showing the absolute values and FIG. 5(*b*) showing its relative value;

FIG 6 (*a*) shows an interpolation section; and FIG. 6 (*b*) a diagram illustrating an algorithm of the section-to-section interpolating algorithm;

FIG. 7 (*a*) shows the relation between a waveform to be output and its section; and FIG. 7*B*) a waveform output flowchart;

FIG 8 (*a*) shows its clock signal; FIG. 8 (*b*) its digital data; and FIG. 8 (*c*) its analog output;

FIG. 10 (*a*) refers to a case where no thermistor for preventing thermal runaway is provided; and FIG. 10 (*B*) a case where such a thermistor is provided;

FIG. 13 (*a*) a conceptual drawing; and FIG. 13 (*b*) a method of generating its driving waveform.

DETAILED DESCRIPTION OF THE PREFERRED EMBODIMENTS

A detailed description will subsequently be given of modes for carrying out the invention with reference to the drawings.

A driving waveform generating device in a first mode for carrying out the invention is used for an ink-jet printer in which a plurality of driving waveforms for causing ink drops different in weight to be discharged are generated and pressure generating elements corresponding in arrangement to a plurality of nozzles of a recording head are actuated by means of the respective driving waveforms, whereby the ink drop corresponding in quantity to the driving waveform is discharged from each nozzle.

Figure 1:
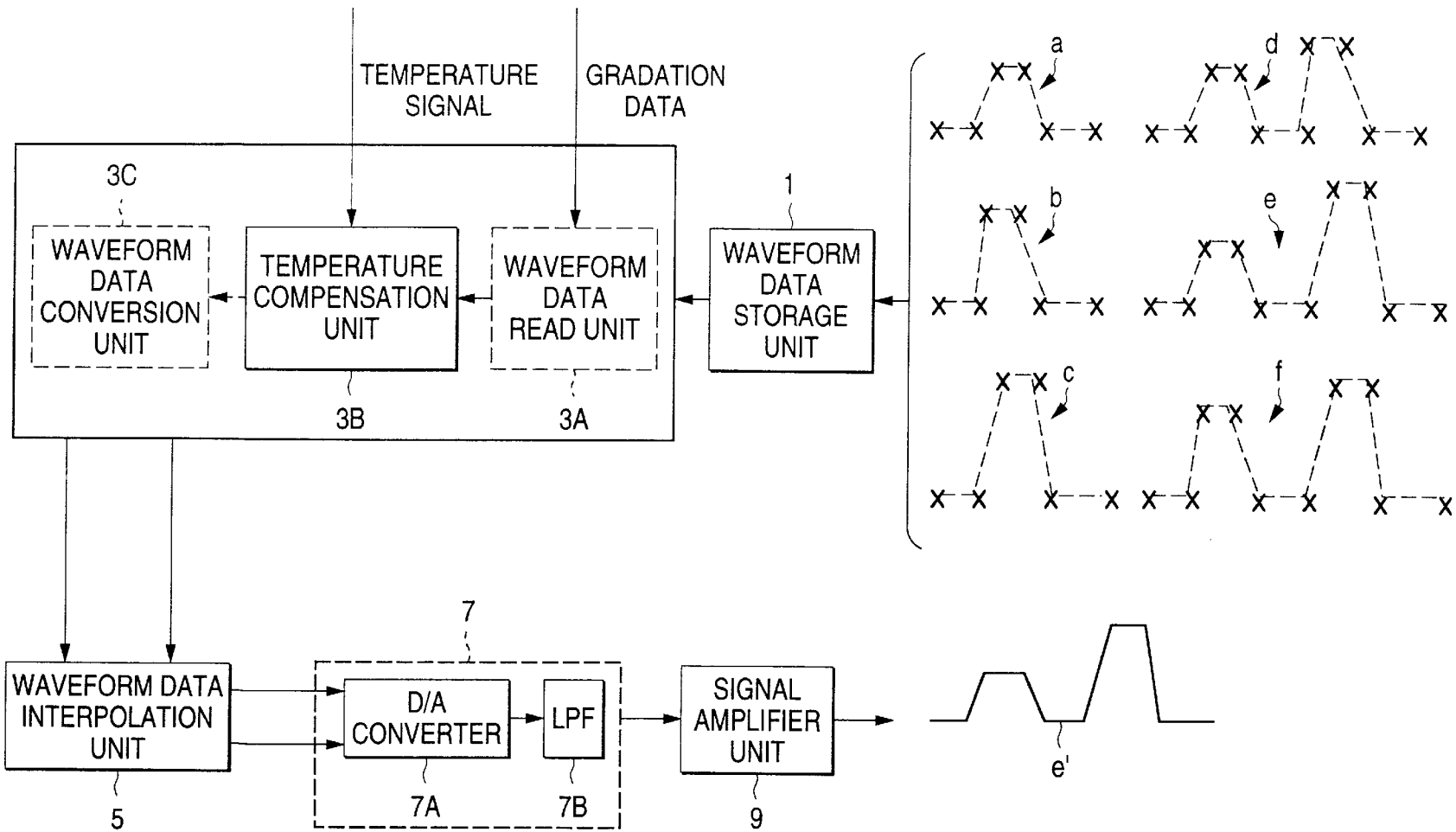
FIG. 1 a functional block diagram showing the construction of a driving waveform generating device for an ink-jet recording head in a first mode for carrying out the invention.

The driving waveform generating device comprises, as shown in FIG. 1, a waveform data storage unit 1 for retaining data at a plurality of points (bent points of trapezoidal waves indicted by Xs in FIG. 1) respectively in a plurality of driving waveforms a–f as digital data on coordinate values by assuming the plurality of driving waveforms a–f including the trapezoidal waves in consideration of ink condition at predetermined temperatures; a waveform data read unit 3A for selectively reading the data on the coordinate values at the plurality of points (10 bent points indicated by Xs) in the desired driving waveforms a–f from the waveform data storage unit 1 according to gradation data during the printing operation; a temperature compensation unit 3B for outputting the corrected temperature based on the difference between the present temperature and the aforesaid predetermined temperature according to the data on the coordinate values at the plurality of points (10 bent points indicated by Xs in the driving waveform ϵ and the same will apply to the following) read by the wwaveform data read unit 3A; a waveform data converter 3C for converting the data on the coordinate values at the plurality of points output from the temperature compensation unit 3B from absolute coordinate values to relative coordinate values; a waveform data interpolation unit 5 for generating waveforms by interpolating point-to-point values with respect to the data on the relative coordinate values at the plurality of points output from the waveform data converter 3C; a D/A conversion unit 7 for subjecting the data on the desired driving waveform interpolated and generated by the waveform data interpolation unit 5 to digital/analog conversion and outputting the converted data in the form of an analog signal; and a signal amplifier unit 9 for amplifying the analog signal representing the desired driving waveform output from the D/A conversion unit 7.

The waveform data storage unit 1 is, as will be described later, in the form of a ROM in a print controller, and the coordinate values in the coordinate system are retained in the predetermined storage areas of the ROM with time on the x-axis and voltage on the y-axis at the plurality of points (indicated by Xs in FIG. 1) in the plurality of driving waveforms a–f resulting from obtaining the voltage and the like in consideration of the ink condition at the predetermined temperature beforehand. The waveform data read unit 3A is in the form a CPU in the print controller likewise is used to selectively read the data on the coordinate values at the plurality of points (10 bent points indicated by Xs) in the desired driving waveform (e.g., the waveform e corresponding to the gradation data from the waveform data storage unit 1. The temperature compensation unit 3B comprises the CPU and thermistor provided in the recording head as will be described later. Since the resistance of the thermistor decreases as the temperature rises, for example, the temperature compensation unit 3B converts the variation of the resistance value between the predetermined temperature and the present temperature at the time of assuming the driving waveform into an electric signal and on receiving the electric signal, it corrects the data on the coordinate values at the plurality of points (e.g., the 10 bent points indicated by Xs in the driving waveform e and the same will apply to the following) read by the waveform data ready unit 3A. The waveform data conversion unit 3C is also in the form of the CPU and converts by calculating the data on the coordinate values at the plurality of points output from the temperature compensation unit 3B from the absolute coordinate values to the relative coordinate values. The waveform data interpolation unit 5 is in the form a gate array and when the waveform data interpolation unit 5 undergoes interruption, the point-to-point values are interpolated by calculation, so that the driving waveform is generated. The D/A conversion unit 7 comprises a D/A converter 7A and a low-pass filter (LPF) 7*b*. A 10-bit, 50 MPS (with a corresponding conversion speed of up to 50 MHz) D/A converter is employed for the D/A converter 7A in this mode for carrying out the invention. In this case, a clock signal having a frequency of 40 MHz is output from an oscillation circuit in the print controller, which will be described later, and the clock signal is divided (halved) into 20 MHz signals in the gate array so as to be used in the D/A conversion unit 7. Moreover, 16-bit data is fed from the CPU forming the waveform data converter 3C and the like to the gate array used to form the waveform data interpolation unit 5, so that the 10-bit data is fed to the D/A converter 7A, though calculation is also made with 16 bits in the gate array. This is because addition is made by increasing the number of bits in the gate array to adopt high-order 10 bits as a result of addition, which is supplied to the D/A converter 7A. The signal amplifier unit 9 is in the form of an amplifier circuit for amplifying the signal having the driving waveform subjected the D/A conversion unit 7 to analog conversion up to a voltage level at which the recording head (piezoelectric oscillator) is driven, and outputs the signal. Thus, the desired driving waveform e' resulting from the temperature compensation and analog conversion is generated.

The function of driving waveform generating device in this mode for carrying out the invention will subsequently described by reference to FIGS. 2–10 in addition to FIG. 1.

In order to use the driving waveform generating device in this mode for carrying out the invention, a printer designer is, as previously noted, to write the absolute coordinate values in the coordinate system to the predetermined storage areas in the waveform data storage unit 1 (ROM) with the t on the x-axis and voltage v on the y-axis at the plurality of bent points (indicated by Xs in FIG. 1) in the plurality of driving waveforms a–f resulting from obtaining the voltage and the like in consideration of the ink condition at the predetermined temperature beforehand for retaining purposes. In this mode for carrying out the invention, the predetermined temperature is set a 25° C. as considered to be normally the room temperature in view of the normal working environmental temperature of the printer ranging from 10° C. to 40° C..

Figure 2:
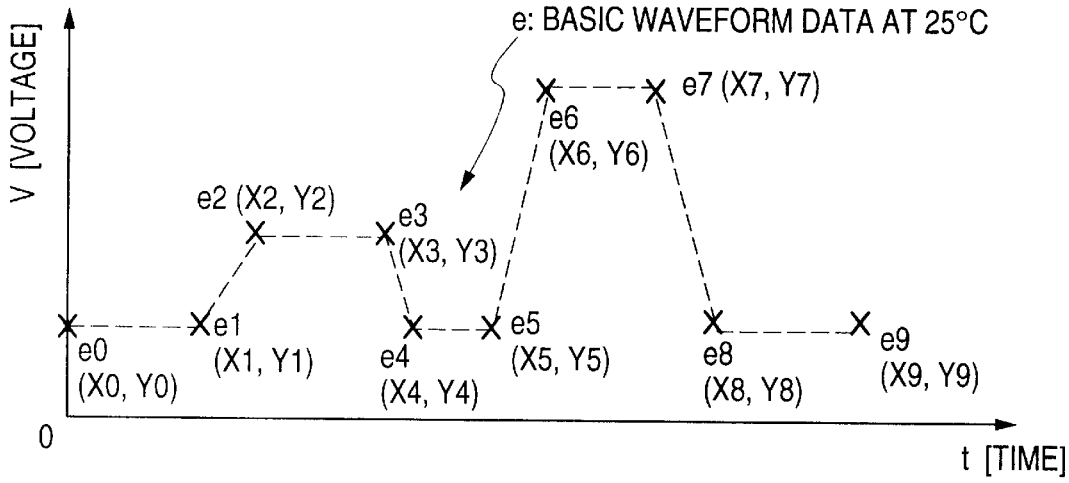
FIG. 2 is a diagram showing a group of coordinate data to be retained in a waveform data storage unit 1 in the driving waveform generating device shown in FIG. 1.
Figure 3:
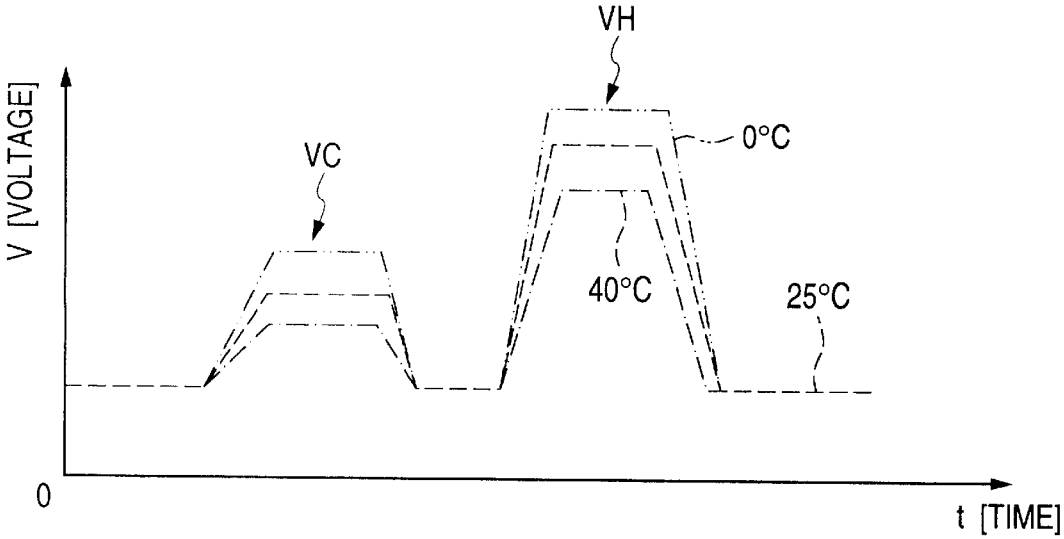
FIG. 3 is a diagram showing a temperature correcting method by means of a temperature compensation unit 3B with respect to the group of coordinate data in the driving waveform generating device shown in FIG. 1.

In the case of the driving waveform e, for example, the absolute coordinate values (X0, Y0)–(X9, Y9) with time t on the x-axis and voltage v on the y-axis at the 10 bent points e0–e9 of basic waveform data at 25° C. are retained as shown in FIG. 2. The same work is repeated six times if there are six kinds of driving waveforms of the recording head of the ink-jet printer.

In this mode for carrying out the invention, since it is only needed to retain each of the bent points, for example, e0–e9 as basic waveform data ta 25° C. in the form of absolute coordinate data, the work of inputting data by the printer designer is facilitated and this is preferred in view of a user interface.

When the printing operation is performed by the ink-jet printer using the driving waveform generating device in this mode for carrying out the invention, data at the plurality of points e0–e9 in the desired driving waveform out of the plurality of driving waveforms, for example, in the driving waveform e is selectively ready from the aforesaid storage areas in the waveform data storage unit 1 by the waveform data read unit 3A on the basis of gradation data as shown in FIG. 1.

Subsequently, the read data at the plurality of points are, as shown in FIG. 1, corrected by the temperature compensation unit 3B at predetermined intervals based on the difference between the printing environment temperature and the aforesaid 25° C.

Ink is softened at high temperature and hardened at low temperatures. The environmental temperature during the time the coordinate value on the driving waveform is retained in the waveform data storage unit 1 beforehand may be different from that during the printing operation. Even during the printing operation, moreover, the temperature in the printer rises because of the heat which various elements generate. Therefore, the voltage which has the basic driving waveform at 25° C. and is applied to the head needs to be corrected in harmony with the temperature during the operation of the printer.

Even in the conventional head driving circuit, temperature compensation has been carried out to the driving waveform applied to the head by varying on the ON time of the aforesaid transistor based on the signal from the thermistor in accordance with the known temperature correcting equation whenever the print of one page is terminated. In this mode for carrying out the invention, the data on the coordinate values at the plurality of points of the driving waveform read by the waveform data read unit 3A are corrected.

In the case of the driving waveform e, for example, driving and intermediate voltages, VH, VC are, as shown in FIG. as, corrected to lower voltages when the environmental temperature is higher than 25° C. and to higher voltages when it is lower than 25° C. in accordance with the known temperature correcting equation. In line with the compensation, the data on the coordinate values at the plurality of points e0–e9 are corrected. Even in this mode for carrying out the invention, the temperature compensation is to be carried out the invention, the temperature compensation to be carried out whenever the printing of one page is terminated; more specifically, when the variation of the resistance of the thermistor provided in the recording head is converted into an electric signal and input to the CPU forming the temperature compensation unit 3B, the CPU corrects the absolute coordinate values at eht plurality of points e0–e9 in the driving waveform e, for example, in accordance with the known temperature correcting equation (function) retained in the ROM beforehand, and the driving waveforms based on the data of the coordinate values at the plurality of points e0–e9 are generated during the printing of one page hereinafter.

Figure 4:
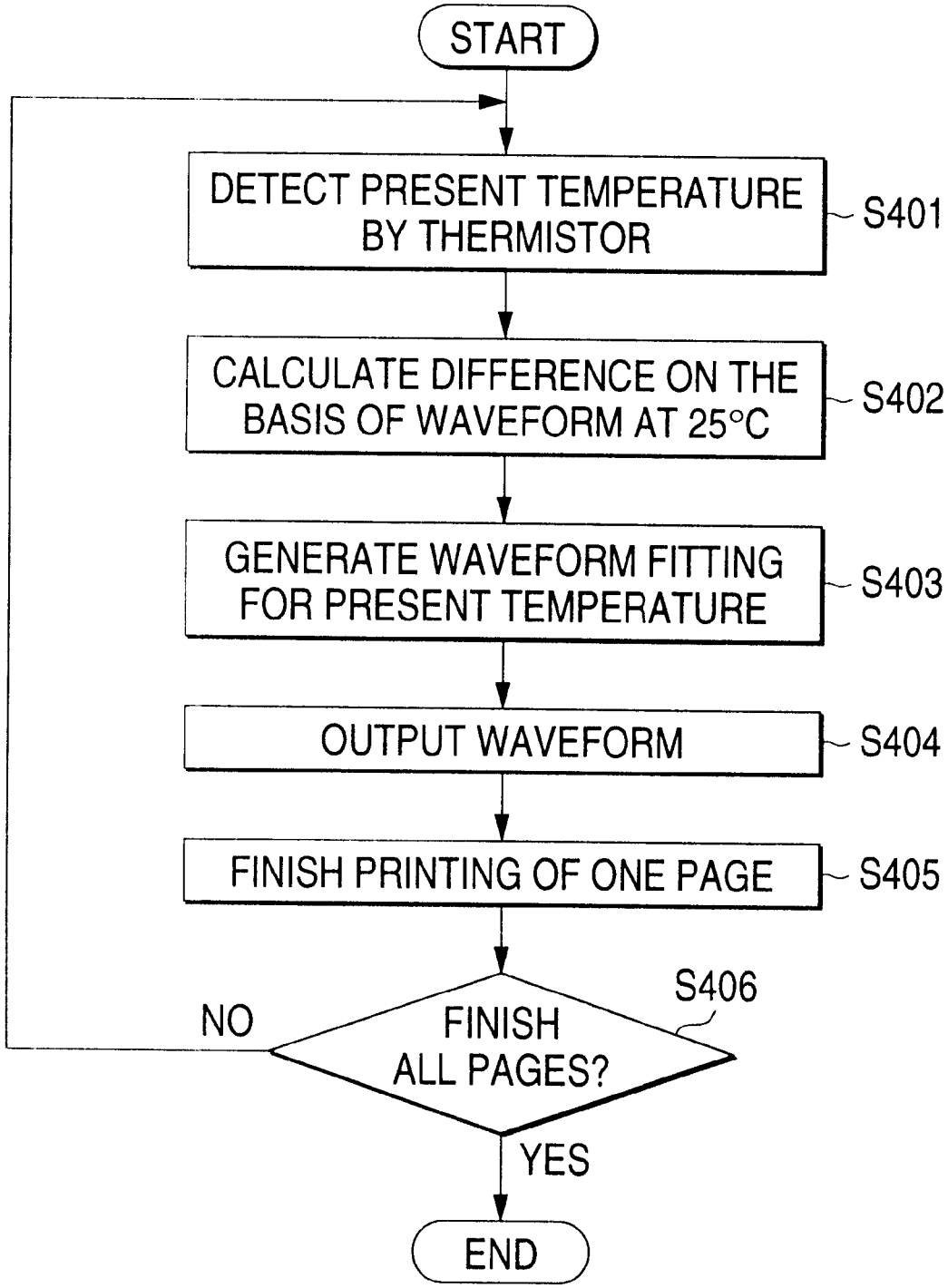
FIG. 4 is a temperature correcting flowchart by means of the temperature compensation unit 3B with respect to the group of coordinate data in the driving waveform generating device shown in FIG. 1.

FIG 4. is a flowchart showing such a temperature compensation.

First, as shown in FIG. 4, the thermistor as a temperature detection unit detects the present temperature (S401) so as to calculate a difference from the present temperature on the basis of the basic waveform at 25° C. (S402). Subsequently, a waveform fit for the present temperature on the basis of the difference (S403) is generated and the waveform thus generated is output (S404). These steps are repeated everything the printing of one page is carried out (S405, S406).

The conversion to the relative coordinate values on the data at the plurality of waveforms and the interpolation of point-to-point values are carried out on the basis of the corrected data on the coordinate values at the plurality of points after the temperature compensation.

The data on the absolute coordinate values at the plurality of bent points subjected to the temperature compensation are converted by the waveform data conversion unit 3C to the data on the relative coordinate values. In this case, by the absolute coordinate value is meant that in the coordinate system with in t on the x-axis and voltage v on the y-axis, it is the coordinate value expressed by two values on the respective x- and y-axis corresponding to each bent point. By the relative coordinate value is meant that, on the other hand, it is the coordinate value expressed by a value defining the extent that each bent point is moved from a bent point directly before the former point.

Figure 5:
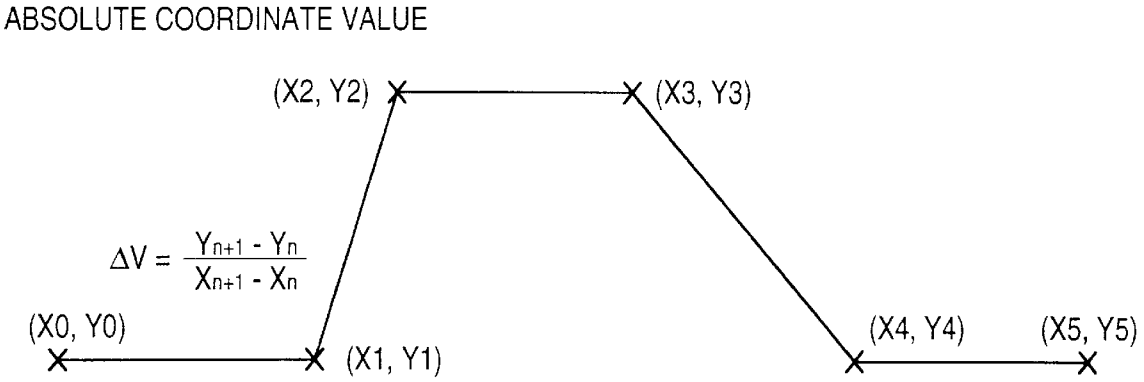
FIGS. 5 (*a*) and (*b*) are diagrams illustrating the way of retaining data on coordinate values at a plurality of points in a driving waveform in the driving waveform generating device shown in FIG. 1.
Figure 5:
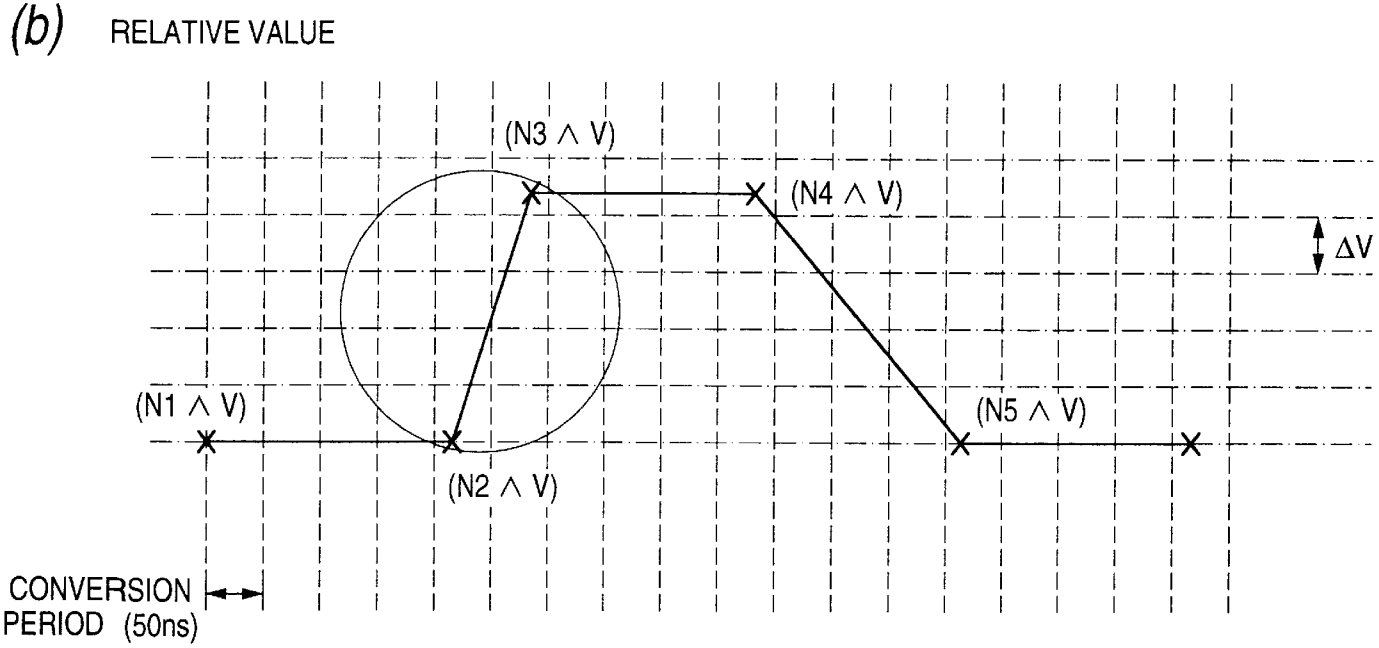

A description will subsequently be given of the reason for the conversion of the data at the plurality of points from the absolute coordinate values to the relative coordinate values. FIGS 5 (*a*), (*b*) show six bent points (e.g., e0–e5 in the aforesaid driving waveform e in the driving waveform including a trapezoidal wave with the absolute coordinate values and the relative coordinate values. In FIG. 5(*b*), the squares shown by dotted lines are, as shown therein, the vertical squares indicate $_{13}$V, whereas the horizontal squares indicate a conversion (sampling) period by means of the latter D/A converter 7A. The driving waveform output by means of the D/A converter 7A ranges from 0 up to 2V and since the 10-bit digital data is subjected to analog conversion, its output voltage swings from 0V (0000000000) up to 2V (1111111111). As the interval between 0–2V is divided into 1,025 ways, $_{13}$V is about 2mV, that is, voltage by 2mV per step is raised.

With respect to the absolute coordinates, the initial inclination of the leading edge of the driving waveform e, for example, is, as shown in FIG. 5(*a*), obtained from $_{13}$V=Yn+1−Yn/Xn+1−Xn With respect to the relative coordinates, on the other hand, the initial leading edge of the driving waveform e, for example, becomes as shown in FIG. 5(*b*) N2=2, and it is apparent that the addition of $_{13}$V twice results in reaching the next bent point (N3, $_{13}$V).

When the data on the absolute coordinates at the plurality of bent points are thus converted by the waveform data conversion unit 3C to the data on the relative coordinates, the following interpolating calculations can be made only by additions. In other words, though the waveform data interpolation unit 5 is constituted by the gate array, the additions are carried out successively on a block basis in the gate array and since the calculation (division) of $_{13}$V is included in the case of the data on the absolute coordinates, the calculation speed may become unsatisfactory; however, because the data $_{13}$V in the data on the relative coordinates has been obtained by the CPU, the calculation speed becomes satisfactory. In other words, the CPU makes preparation calculation of driving waveforms which will vary next before a signal for seeking the next driving waveform is applied to the gate array.

Figure 6:
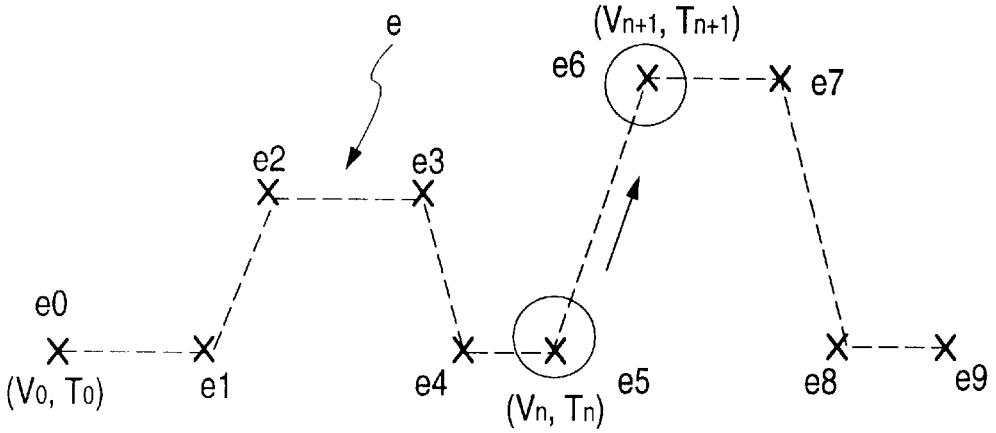
FIGS. 6(*a*) and (*b*) are diagrams showing a method of interpolating the point-to-point by a waveform data interpolation unit 5 with respect to the group of coordinate data in the driving waveform generating device shown in FIG. 1.
Figure 6:
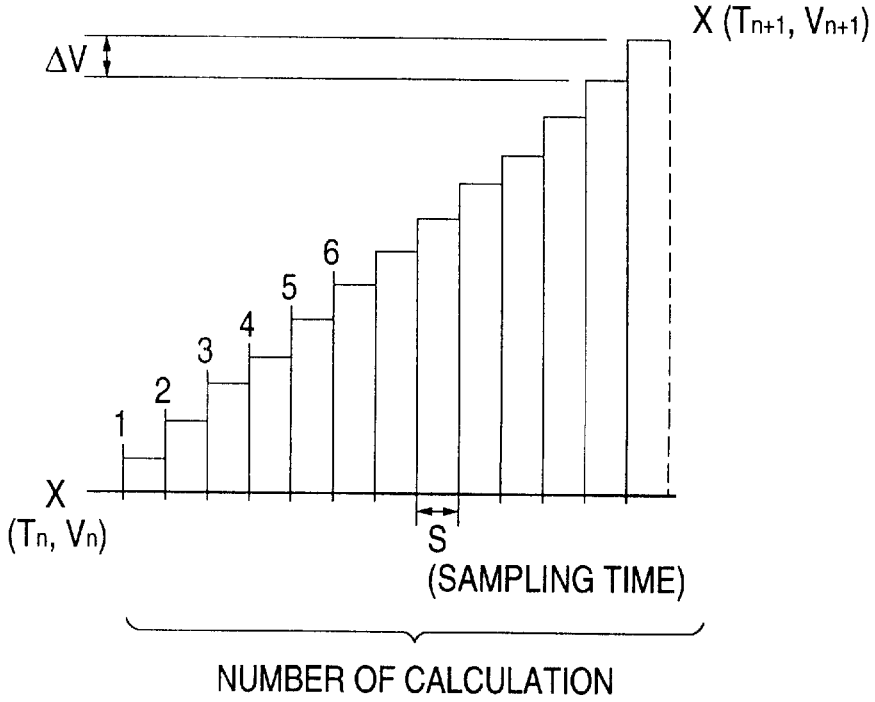

For example, the quantity of movement from a point e5 to a point e6 in the driving waveform a shown in FIG. 6 (*a*) is calculated as follows:

given the number of calculations in a section of n' n=1: the number of calculation =Tn+1 −Tn/As (sampling time) given the number of steps per sampling time:

$_{13}$V=Vn+1−Vn/the number of calculations the quantity of movement from n to n+1 is thus calculated as shown in FIG. 6(*b*).

The number of steps per sampling time, that is, the number of steps to be moved up every time clock signal is introduced once is obtained from the value $_{13}$V, and the quantity of movement from n to n=1 is calculated thereby.

Subsequently, with respect to the data on the relative coordinates at the plurality of points thus converted by the waveform data conversion unit 3C, the point-to-point values are interpolated by the waveform data interpolation unit 5, whereby driving waveforms with the aforesaid environmental temperature taken into consideration are created.

The number of calculations and the value of ΔV are set in the gate array constituting the waveform data interpolation unit 5 (the number of calculations is set in the counter within the gate array) and the gate array makes necessary interpolating calculations, so that driving waveforms with the interpolated point-to-point values are output.

Figure 7:
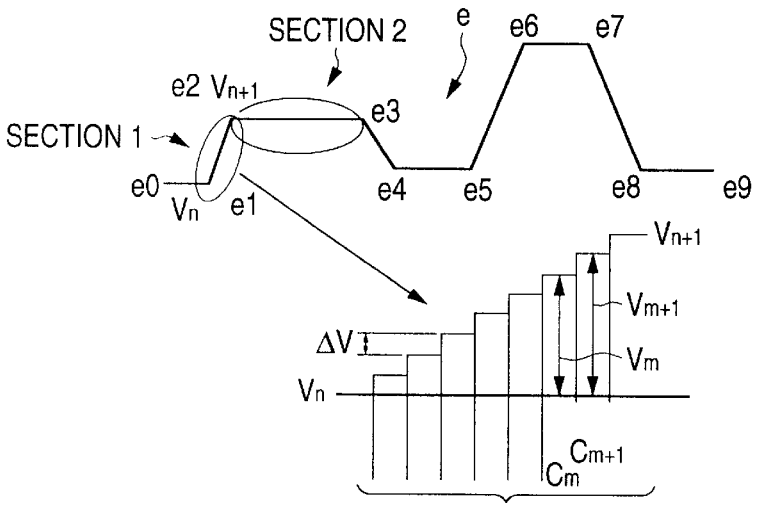
FIGS. 7 (*a*) and (*b*) are diagrams showing a method of outputting a waveform by means of the waveform data interpolation unit in the driving waveform generating device shown in FIG. 1.
Figure 7:
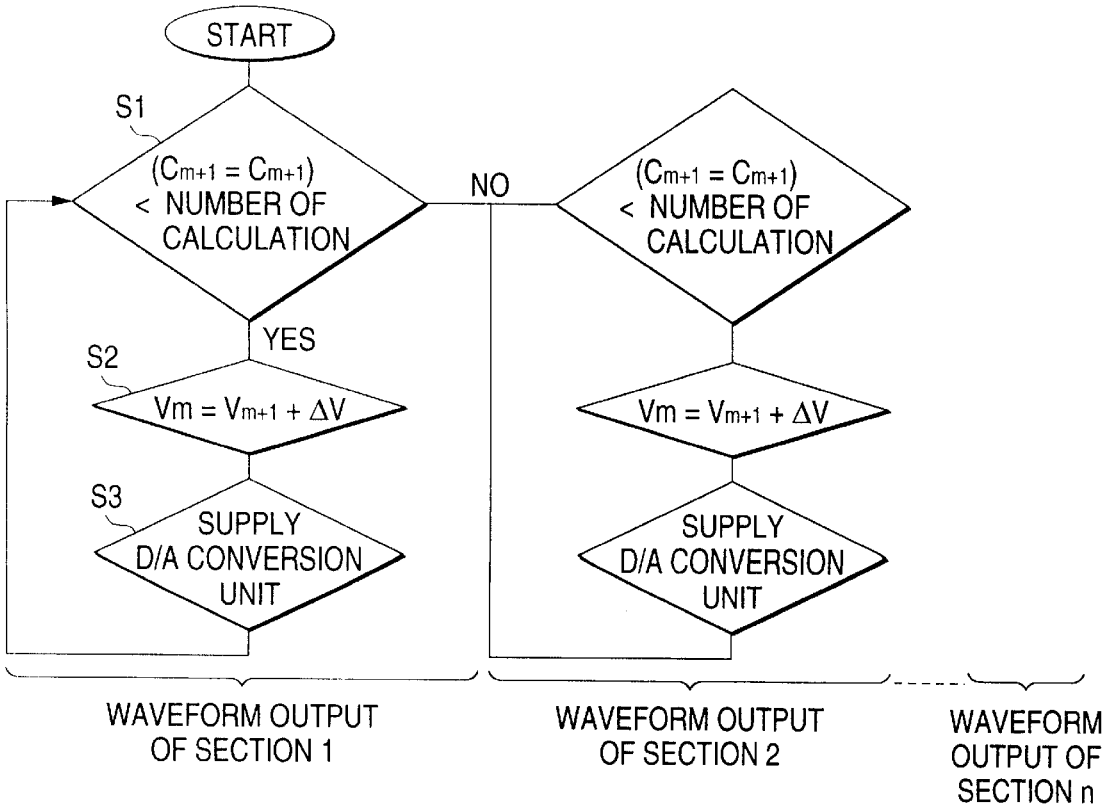

As shown in FIG. 7(*a*), a section 1 (from e1 to e2) and a section 2 (from e2 to e3) in the aforesaid driving waveform e, for example, are considered. Given that the voltage at the start point e1 in the section 1 is Vn and that the voltage at the end point e2 therein is Vn+1, since the value of ΔV has been obtained, voltage Vm when the number calculations is m, and voltage Vm+1 when the number of calculations is m+1 are obtainable from a flowchart of FIG. 7 (*b*). More specifically, it is judged, as shown in FIG. 7(*b*), whether or not $C_{m+1}$=$C_m$+1 is smaller than the number of calculations with respect to the waveform outputs in the section 1 shown in FIG. 7(*a*) (S1). With the internal counter, the number of calculations is counted like 1, 2, 3, 4 and when a certain set value is reached, the counter is reset and caused to start counting for the next section 1 so as to add 1 to the preceding value each time, that is, the calculation is continued until the number of calculations is reached. When Vm=Vm+1+ΔV is justified (S2), this data is supplied to the D/A conversion unit 7 (S3). These calculations are repeated from the sections 1, 2, 3, . . . section n, so that driving waveforms with the interpolated point-to-point values are output.

Then the data on the desired driving waveform interpolated and created by the waveform data interpolation unit 5 is subjected by the D/A conversion unit 7 to analog conversion before being output as the analog signal.

Since the data calculated by the waveform data interpolation unit 5 formed with the gate array via the ROM and CPU is digital data, this data is converted to the analog signal by the D/A converter 7A and the low-pass filter (LPF) 7B in order to generate a complete driving waveform.

Figure 8:
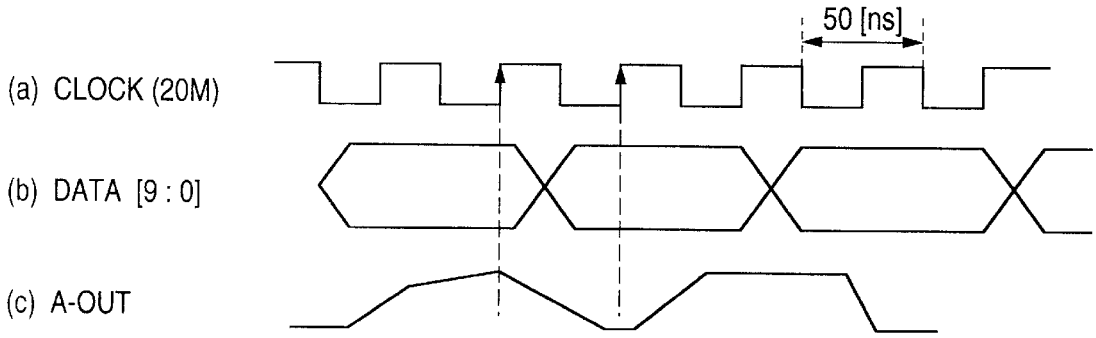
FIGS. 8 (*a*) to (*c*) are diagrams explanatory of the operation of a D/A converter 7A in the driving waveform generating device shown in FIG. 1.

FIG. 8 shows a timing chart explanatory of the operation of the D/A converter 7A.

As shown in FIG 8(*a*), the 10-bit digital data output from the waveform data interpolation unit 5 under the clock signal at a frequency of 20 MHz as shown in FIG. 8(*b*) is converted by the D/A converter 7A into an analog output as shown in 8 (*c*). With the clock signal at a frequency of 20 MHz as a reference, the space between the leading edges of the clock signal amounts to 50 ns.

As shown in FIGS. 8(*a*), (*b*) and (*c*), the 10-bit digital data is converted into the analog output at the leading edge of the clock signal, and addition is made for the next data within 50 ns time between the leading edges of the clock signal.

The output of the D/A converter 7A contains stepwise high-frequency components corresponding to the conversion period. Therefore, the output of the D/A converter 7A is passed through the low-pass filter (LPF) 7B so as to remove the high-frequency components.

Further, the analog signal representing the desired driving waveform output from the D/A conversion unit 7 is amplified by the signal amplifier unit 9 before being output.

Since the 10-bit digital data is converted into the analog output in the D/A converter 7A, the output voltage swings from the 0V (0000000000) to 2V (1111111111).

However, because a voltage of about 40V is required to drive the head (piezoelectric oscillator), the analog signal output from the D/A conversion unit 7 is amplified to such a voltage level.

Figure 9:
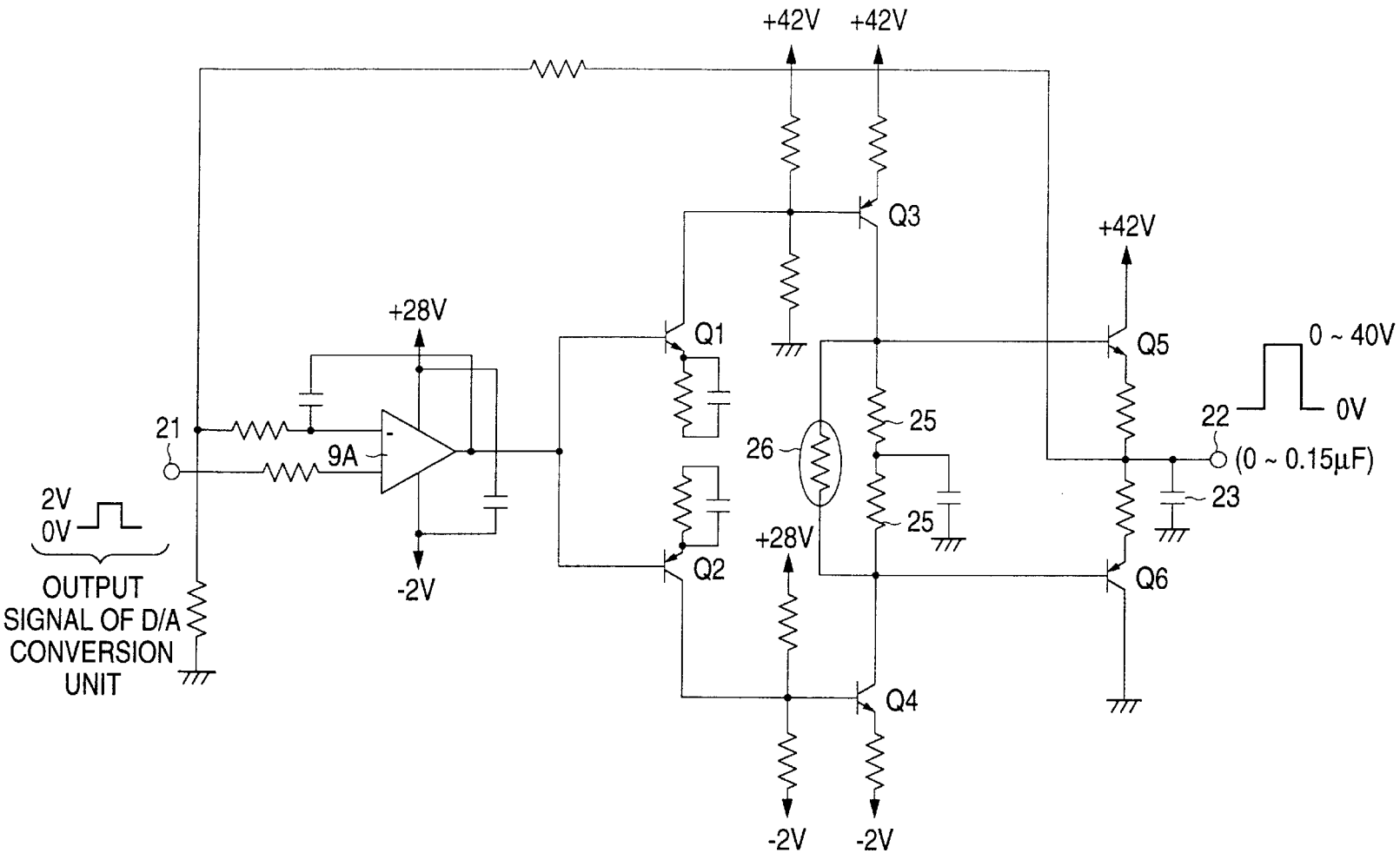
FIG. 9 is a diagram showing the construction of a signal amplifier unit 9 in the driving waveform generating device shown in FIG. 1.

FIG. 9 shown an arrangement of an amplifier circuit for use in the signal amplifier unit 9.

The amplifier circuit comprises, as shown in FIG. 9, an operational amplifier 9A at a first stage, a pair of transistors Q1, Q2 at a second stage, a pair of transistors Q3, Q4 at a third stage, and a pair of transistors Q5, A6 at a fourth stage, these transistors together with capacitors and resistors being connected as shown in FIG. 9, respectively. Each pair of transistors are connected so as to form a mirror circuit. The output signal of the D/A converter 7A is input to the input terminal 21 of the amplifier circuit and output from an output terminal 22 as a driving signal for forming the desired driving waveform e (see FIG. 1) swinging from 0A to 40A via the operational amplifier 9A, the transistors Q1, Q2, Q3, Q4, and Q5, Q6 so as to drive a head (piezoelectric vibrator) 23.

Figure 10:
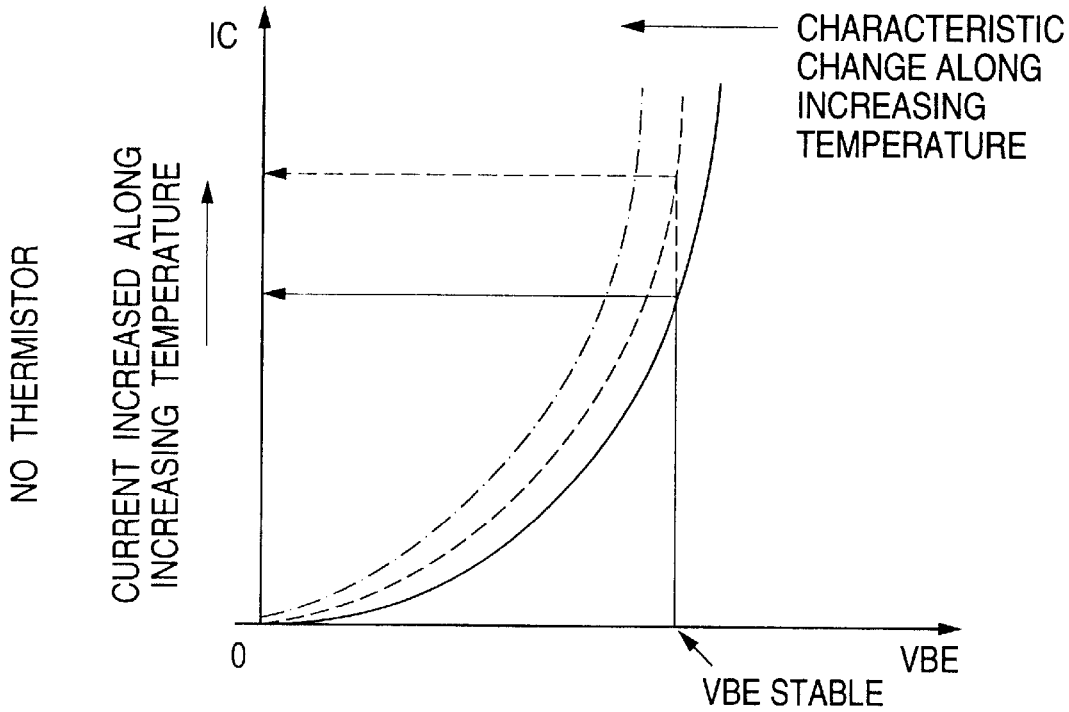
FIG. 10 (*a*) and (*b*) are diagrams explanatory of collector current changes due to the self-heat generation of a transistor in the amplifier circuit shown in FIG. 9.
Figure 10:
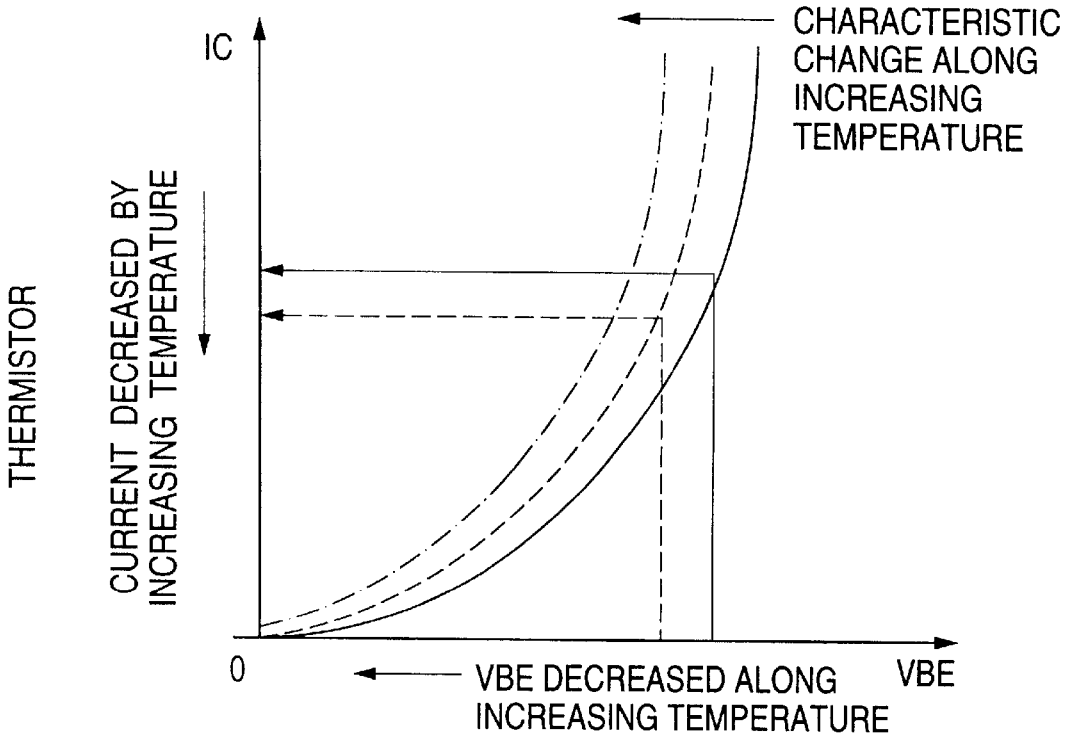

In the amplifier circuit shown in FIG. 9, in order to amplify the driving waveform so that it rises up to 0–40V within a short time of 2 μs (microseconds), the transistors Q3, Q4, Q5, Q6, are made to operate in an active area (so-called A-class operation of the amplifier) by causing current to flow through the transistors at all times. In other words, as shown in FIG. 9, a current of 30 mA is caused to flow between the collector•emitter of the transistors Q3, Q4, and a resistor of 16.2 Ω is installed between the base transmitter of the transistors Q5, Q6. By applying a voltage of 30[mA]×16.2[ Ω]=0.486= about 0.5 [V] according to V=IR (Ohm's law) between the base•emitter of the transmitters Q5, Q6 as the product of the current of 30 mA and the resistance value of 16.2 Ω, a current of several mA is made to flow between the collector•emitter of the transistors Q5, Q6 at all times. Although amplification in as a short time as 2 μs (microseconds) is made possible thereby, the adoption of the aforesaid circuit arrangement renders it necessary to prevent the thermal runaway of the transistors Q5, Q6. More specifically, as shown in FIG. 10(*a*), the IC (collector current)—VBE (voltage between base•emitter) characteristics of a silicon semiconductor changes, as shown in FIG. 10(*a*), from the state indicated by a solid line to what is indicated by a dotted line as the temperature rises. However, since the voltage between the base•emitter is always maintained at about 0.5 [V] as previously noted, the collector current of the transistors Q5, Q6 increases, whereby the IC=VBE characteristics are shifted to the left-handed side of FIG. 10(*a*) as indicated by a chain line because of collector loss (heat generation). Consequently, there is the fear that the transistors Q5, Q6 may be destroyed because the repetition of the heat generation results in exceeding the temperature limit of the npn or pnp junction.

In this mode for carrying out the invention, therefore, a thermistor 26 having the same resistance value as that of 16.2 Ω is connected in parallel in order to by-pass the resistor 25 of 16.2 Ω between the collector collector of the transistors Q3, Q4 to reduce the voltage between the base•emitter of the transistors Q5, Q6 when the voltage between the base•emitter thereof rises because of their self-generation of heat. The thermistor has negative resistance, that is, is characterized in that as its temperature rises, its resistance value decreases. In consequence, even when the current value of 30 mA between the collector•emitter of the aforesaid transistors Q3, Q4 remains unchanged, the voltage between the base•emitter of the transistors Q5, Q6 as the product of the current value of 30 mA and the voltage therebetween is caused to decrease as the temperature rises by connecting the thermistor 26 having the same resistance value as that of 16.2 Ω of the resistor 25 for regulating the voltage between the base•emitter of the transistors Q5, Q6 in parallel to each other in such a way as to by-pass the latter. Since the VBE lowers as the temperature rises as shown in FIG. 10(*b*), the IC (collector current) turns to decrease, so that the thermal runaway is prevented.

In the current arrangement shown in FIG. 9 in this mode for carrying out the invention, the driving waveform can be amplified in as short time as 2 μs (microsecond) by keeping the current flowing through the transistors Q3, Q4, Q5, Q6 to operate these transistors (the so-called A-class operation of the amplifier) in the active area. In addition, by connecting the thermistor 26 having the same resistance value as that of 16.2 Ω of the resistor 25 between the collector•collector of the transistors Q3, Q4 in parallel to each other in such a way as to by-pass the latter, the thermal runaway can be prevented so as to decrease the voltage between the base•emitter of the transistors Q5, Q6 as the voltage between the base•emitter thereof rises because of their self-generation of heat. The use of a thermal runaway preventive circuit as the thermistor is effective in a case where heat radiation is restricted or the size of a heat radiating plate is limited in design-making when the space is taken into consideration.

The place where the thermistor is installed is not limited to what is shown in FIG. 9 but may be anywhere the voltage between the base emitter of the transistors Q5, Q6 turns to decrease as the temperature rises, and the same effect is achievable by providing one thermistor between the base•emitter of the transistor Q5 and also one thermistor between the base•emitter of the transistor Q6. However, additional cost for the two thermistors is needed and if variations in their characteristics exist, the amplification characteristics of the whole circuit may be badly affected. In this mode for carrying out the invention, the installation of only one thermistor is designed and advantageous in view of manufacturing cost. Therefore, there is no ground for anxiety arising from variations in the characteristics of thermistors.

Figure 11:
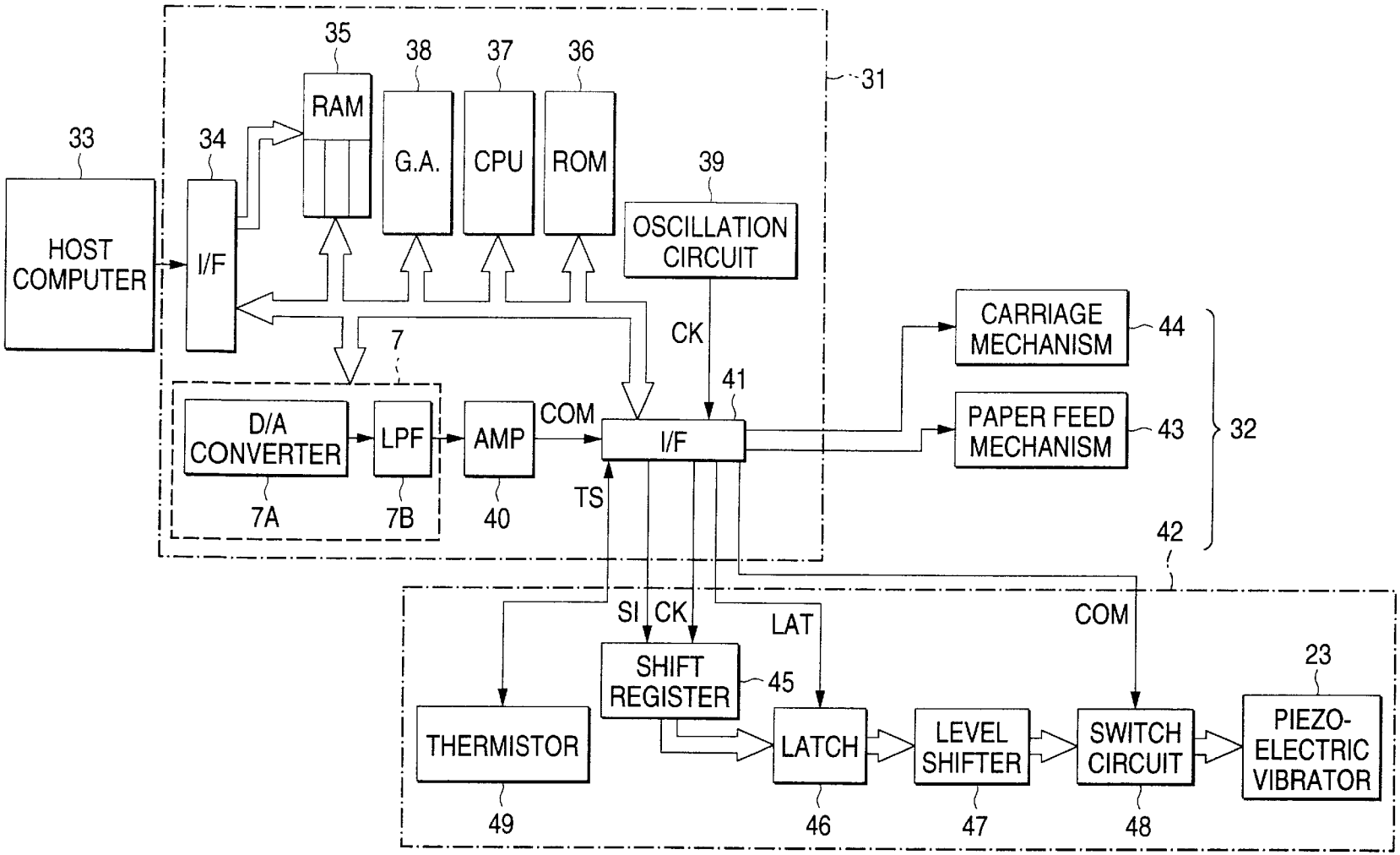
FIG 11 is a diagram showing an example fit for an ink-jet printer in the first mode for carrying out the invention.

FIG. 11 shows an example of applying the driving waveform generating device in this mode for carrying out the invention to an ink-jet printer.

As shown in FIG. 11, the ink-jet printer comprises a print controller 31 and a print engine 32.

The print controller 31 comprises an interface (hereinafter called "I/F") 34 for receiving print data and the like from a host computer 33; a RAM 35 for storing various data, a ROM 36 which stores routines for use in processing various data and functions as the waveform data storage unit 1 in this mode for carrying out the invention; a CPU 37 which plays key control roles and also functions as the waveform data read unit 3A, the temperature compensation unit 3B and the waveform data conversation unit 3C; a gate array 38 which performs processes of maintaining•switching the value of current for driving a carriage mechanism, which will be described later, and also functions as the waveform data interpolation unit 5; an oscillation circuit 39 for producing a clock signal (CK) of 40 MHz, for example, as a reference for processing various data in a printer; an amplifier circuit 40 including the D/A converter 7A and the low-pass filter (LPF) 7B constituting the D/A conversion unit 7, and the signal amplifier unit 9 in this mode for carrying out the invention; and an I/F 41 for transmitting to the print engine 32 print data developed in a dot pattern data (bit map data) and driving signals and the like output from the amplifier circuit 40.

The print engine 32 comprises a recording head 42, a paper feed mechanism 43, and a carriage mechanism 44. The recording head 42 has a number of nozzles, and an ink drop is discharged from each nozzle at predetermined timing. The print data developed in the dot pattern data is transmitted from the I/F 41 to a shift register 45 within the recording head 42 in synchronization with the clock signal (CK) from the oscillation circuit 39. The print data (S1) serially transmitted is latched in a latch circuit 46 once. The printer data thus latched is raised by a level shifter 47 as a voltage amplifier up to 40V as a predetermined voltage value at which a switch circuit 48 is driven. The print data raised up to the predetermined voltage value is given to the switch circuit 48. A driving signal (COM) output from the amplifier circuit 40 is applied to the input side of the switch circuit 48, and the piezoelectric vibrator 23 is connected to the output side of the switch circuit 48. Further, the recording head 42 is provided with a thermistor 49. The thermistor 49 functions, as noted previously, as the temperature compensation unit 3B together with the cpu 37. In other words, since the thermistor 49 has negative resistance, the resistance value decreases as the temperature rises, for example. The variation of the resistance value to converted into an electric signal (TS) and on receiving the electric signal (TS), the CPU 37 corrects the data on the coordinate values at the property at the plurality of points in the driving waveform. Incidentally, through the temperature compensation like the temperature compensation in the conventional ink-jet printer may be made every time the printing of one page or one line is terminated, the temperature compensation is to be made every time the printing of one page is terminated in this mode for carrying out the invention. In this case, the shift register 45, the latch circuit 46, the level shifter 47, the switch circuit 48 and the piezoelectric vibrator 23 are each constituted of a plurality of elements corresponding to the respective nozzles of the recording head 42. When the bit data applied to each switching element of the switch circuit 48 in the form of an analog switch is [1], the driving signal (COM) is applied to each piezoelectric vibrator, which is displaced according to the driving waveform of the driving signal (COM). When the bit data is applied to each switching element is [0], the driving signal (COM) to each piezoelectric vibrator is cut off and each piezoelectric vibrator holds the charge immediately before.

In the ink-jet printer to which the driving waveform generating device in this mode for carrying out the invention is applied, when the print data developed in the dot pattern data applied to the switch circuit 48 is [1], for example, the driving signal (COM) formed with the desired waveform e' is applied to the piezoelectric vibrator 23 as previously noted, and the piezoelectric vibrator 23 expands and contracts according to the driving signal, thus causing the ink drop to be discharged from the nozzle involved according to the driving waveform e', so that a dot having a gradation value corresponding to the driving waveform e' is formed. When the print data applied to the switch circuit 48 is [0], the supply of the driving signal (COM) to the piezoelectric vibrator 23 is cut off. The printing operation is then performed according to the dot pattern data, and ink drops different in weight can be discharged from the same nozzle, whereby a multi-gradation image of good quality can be printed by variably adjusting the recording dot diameter on printing paper.

A description will subsequently be given of a driving waveform generating device in a second mode for carrying out the invention.

Although the driving waveform generating device in the second mode for carrying out the invention is substantially similar in construction to the driving waveform generating device in the first mode for carrying out the invention, the former is not equipped with the waveform data conversion unit 3C but characterized in that data at the plurality of bent points in the plurality of driving waveforms a–f are retained in the waveform data storage unit 1 as data on relative coordinate values from the beginning.

More specifically, in the case of the driving waveform generating device in this mode for carrying out the invention, a printer designer writes coordinate values in a coordinate system with time t and the x-axis and voltage v on the y-axis at the plurality of bent points in the plurality of driving waveforms a–f after voltage and the like are obtained after giving consideration to ink condition at a predetermined temperature beforehand to predetermined storage areas of the waveform data storage unit 1 (ROM 36) as in the first mode for carrying out the invention; however, the relative coordinates shown in FIG. 5(*b*) instead of the absolute coordinates shown in FIG. 5(*a*) are retained.

In this mode for carrying out the invention, the clock signal of 20 MHz output from oscillation circuit 39 is directly used as a reference clock signal for the D/A converter 7A and consequently the space between the leading edges of the clock signal amounts to 50 ns. The relative coordinates are such that, as shown in FIG. 5(*b*), N2=2 in the initial leading edge portion of the aforesaid driving waveform e and when _V is added N2times, the next bend point (N3, _V) can obviously be reached. Thus, the process of interpolating waveform data can be performed satisfactorily even in as a short time as 50 ns because the waveform data storage unit 1 (ROM 36) holds data on _V beforehand in this mode for carrying out the invention.

Unlike the first mode for carrying out the invention, moreover, the process of converting the absolute coordinate values of the waveform data to the relative coordinate values thereof by means of the CPU 37 can be dispensed with. Therefore, in this mode for carrying out the invention, the driving waveform is formed after giving due consideration to the aforesaid environmental temperature by making the waveform data interpolation unit 5 interpolate the point-to-point values with respect to the data on the relative coordinate values at the plurality of point in the driving waveform corrected by the temperature compensation unit 3B.

In the first and second modes for carrying out the invention, through the driving waveform has been generated by assuming the ink condition during the printing operation on the basis of the environmental temperature and correcting the coordinate data by means of the temperature compensation unit 3B, environmental condition to be taken into consideration is not limited to the temperature but may include the assumed ink condition at the time of printing based on the environmental temperature.

In the first and second modes for carrying out the invention, further, the group of coordinate data (coordinate data on the bent points in the driving waveform a–f) are prepared (a–f), through any one in the group of coordinate data (e.g., coordinate data on the bent points in the driving waveform e is selectively read out so as to generate the driving waveform e' corresponding to the gradation data, the following third and fourth modes for carrying out the invention are also possible.

In the third mode for carrying out the invention first, they may be considered the steps of creating one driving waveform by reading a group of coordinate data, and selectively utilizing parts of the driving waveform in order to drive the recording head according to gradation data.

A description will subsequently be given by using the driving waveforms a–f in FIG. 1. One driving waveform containing pulses of a plurality of trapezoidal waves is prepared by sequentially synthesizing, for example, driving waveforms a, b and c in order after reading a group of coordinate data. When a gradation value is 0, (000) is set and none of the trapezoidal wave pulses a. b and c is selected. When the gradation value is 1, (100) is set and only the trapezoidal wave pulse a is selectively driven. When the gradation value is 2 similarly, (010) is set and only the trapezoidal wave pulse b is selectively driven, . . . when the gradation value is 6, (011)is set and only the trapezoidal pulses b and c are selectively driven and so forth.

In the fourth mode for carrying out the invention, there may be considered the steps of selectively reading part of the group of coordinate data in order to properly create a driving waveform corresponding to gradation data, and driving the recording head by utilizing the driving waveform.

More specifically, this is a case where a coordinate data is selectively read from one waveform prepared according to the gradation value in order to create carious waveforms by using the driving waveforms a–f of FIG. 1. Even in this case by reference to the driving waveforms a–f of FIG. 1, part [coordinate data S0,Y0–(X5, Y5) up to e0–e5] of the group of coordinate data [coordinate data (X0, Y0)–X9, Y9) up to e0–e9] of the driving waveform e is selectively read to create a driving waveform corresponding to the gradation value 1 in order to drive the recording head by utilizing the driving waveform.

As is obvious form the third and fourth modes for carrying out of the invention, the various ways of creating the driving waveform are considered andconsequently a programmable driving waveform may be obtained by the use of group of coordinate data for generating driving waveforms retained beforehand.

Figure 12:
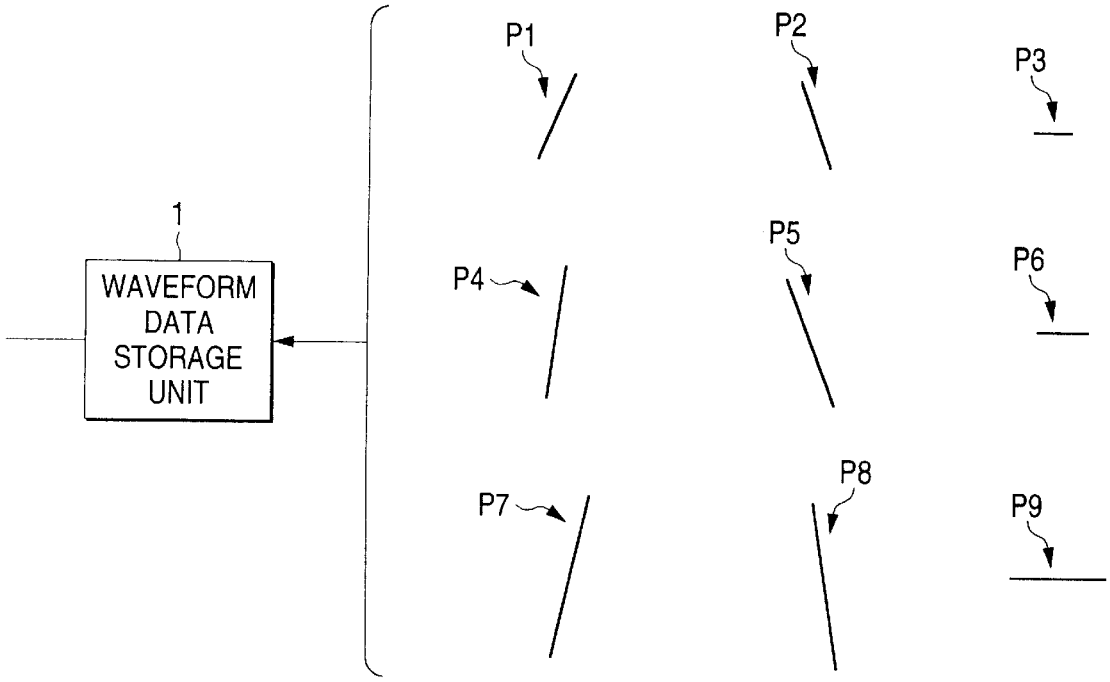
FIG. 12 is a diagram illustrating a fifth mode for carrying out the invention.
Figure 13:
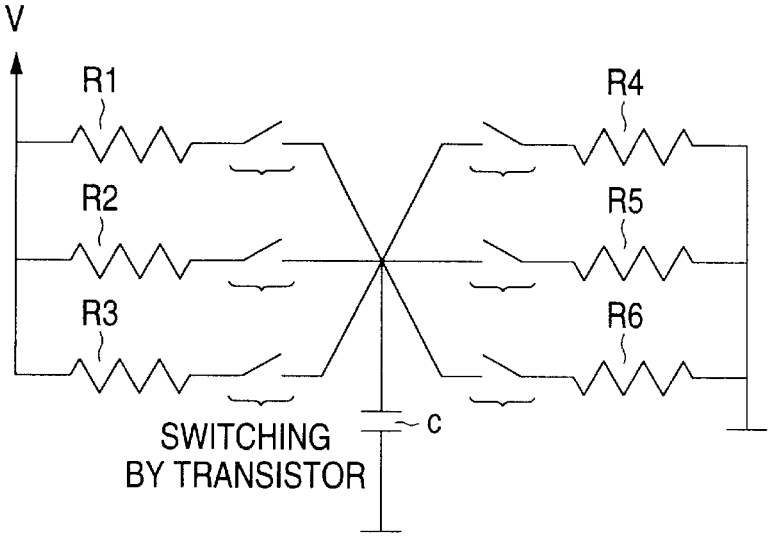
FIG. 13 (*a*) and (*b*) are diagrams illustrating a conventional head driving circuit.
Figure 13:
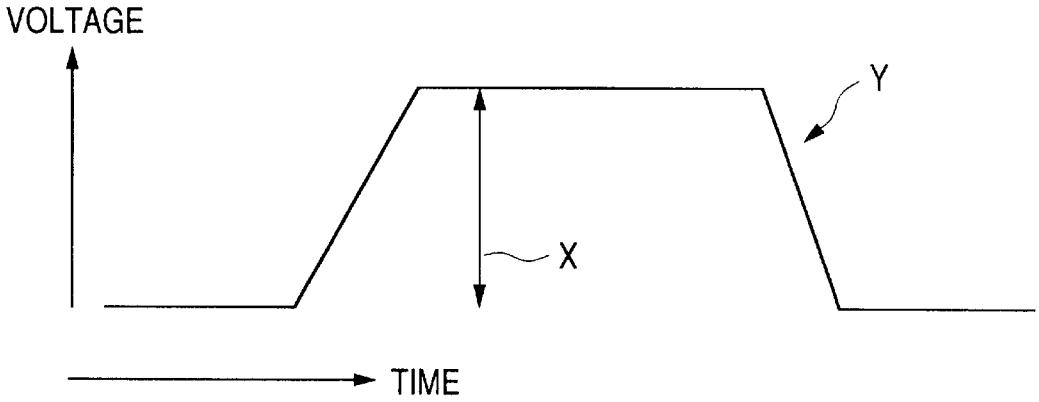

Further, a fifth mode for carrying out the invenion as shown in FIG. 12 is possible.

Contrary to the first to fourth modes for carrying out the invention in which the coordinate data are retained in the waveform data storage unit 1 in the way the data is interpolated to generate a given waveform, data on parts of the driving waveform, P1–P9, for example, are retained in the waveform data storage unit 1 as shown in FIG. 12 in the fifth mode for carrying out the invention. The CPU then properly selects one of them according to the gradation value and combines them into a driving waveform (part retaining system). Even in this mode for carrying out the invention, it is possible to generate the desired programmable driving waveform by changing data on part of the waveform retained or changing the way of selecting or combining the parts. Moreover, the interpolating process can be dispensed with in this mode for carrying out the invention.

Although a description has been given of various modes for carrying out the invention, the invention is not limited to these modes thereof but may needless to say be applicable to any other mode for carrying out the invention in which, for example, a driving waveform generating device is provided with no temperature compensation unit 3B and the like without departing the scope and spirit of the invention.

Moreover, a driving waveform to be generated is not limited to a trapezoidal wave or what is linear but may be considered those having curved configurations by interpolating a group of retained coordinate data with curved lines of subjecting them to spline interpolation.

As set forth above, in the driving waveform generating device and method according to the present invention, the group of coordinate data for generating driving waveforms or the group of data on part of the waveforms are retained beforehand and the group of data read. Further, by interpolating the point-to-point value properly combining the data on parts of the driving waveform to produce the driving waveform, the signal having this driving waveform is subjected to the D/A conversion, amplified before being out, so that the desired programmable driving waveform is obtainable through the simple procedure for retaining the group of data for generating the driving waveform for use in the printer involved.

Moreover, many gradation expressions are made possible by changing an algorithm for interpolating coordinate data to be retained and the point-to-point value or otherwise an algorithm for selecting and combining partial data to be retained.

What is claimed is:

1. A driving waveform generating device for an ink-jet recording head, the driving waveform generating device generating at least one presumed driving waveform in order to drive the recording head according to gradation data by utilizing the driving waveform, the driving waveform generating device comprising:

waveform data storage means having a group of waveform data for generating the driving waveform;

waveform data read means for selecting at least one utilizing waveform data from the group of waveform data and reading the selected waveform data;

waveform data generating means for performing the required arithmetic process on the waveform data read by the waveform data read means in order to create driving waveform;

digital/analog conversion means for subjecting data on the driving waveform created by the waveform data generating means to digital/analog conversion in order to output an analog signal; and signal amplification means for amplifying the analog signal which has been output from the digital/analog conversion means.

2. A driving waveform generating device for an ink-jet recording head, the driving waveform generating device generating at least one presumed driving waveform in order to drive the recording head according to gradation data by utilizing the driving waveform, the driving waveform generating device comprising:

waveform data storage means having a group of coordinate data for generating the driving waveform;

waveform data read means for selecting at least one utilizing waveform data from the waveforms and reading the group of coordinate data for the driving waveform;

waveform data interpolation means for creating the driving waveform by interpolating point-to-point values into the group of coordinate data read by the waveform data read means;

digital/analog conversion means for subjecting data on the driving waveform created by the waveform data interpolation means to digital/analog conversion in order to output and analog signal; and signal amplification means for amplifying the analog signal which has been output from the digital/analog conversion means.

3. A driving waveform generating device for an ink-jet recording head as claimed in claim 2, wherein a plurality of groups of coordinate data are prepared, any one of the groups of coordinate data are read, and a proper driving waveform corresponding to the gradation data is created from plurality of groups of coordinate data so as to drive the recording head by utilizing the driving waveform.

4. A driving waveform generating device for an ink-jet recording head as claimed in claim 2, wherein one driving waveform is created by reading out the group of coordinate data; and parts of the driving waveform are selectively utilized so as drive the recording head according to the gradation data.

5. A driving waveform generating device for an ink-jet recording head as claimed in claim 2, wherein the driving waveform corresponding to the gradation data is created properly by selectively reading parts of the group of coordinate data so as to drive the recording head by utilizing the driving waveform.

6. A driving waveform generating device for an ink-jet recording head as claimed in claim 2, wherein a trapezoidal wave is contained in the generated waveform.

7. A driving waveform generating device for an ink-jet recording head as claimed in claim 2, wherein the generated driving waveform is linear in the case of a gradation without forming dots by utilizing the driving waveform.

8. A driving waveform generating device for an ink-jet recording head as claimed in claim 2, further comprising:

compensation means for correcting the coordinate data in consideration of ink condition during a printing operation.

9. A driving waveform generating device for an ink-jet recording head as claimed in claim 8, wherein the ink condition taken into consideration during the printing operation is based on at least environmental temperatures.

10. A driving waveform generating device for an ink-jet recording head as claimed in claim 8, wherein the ink condition taken into consideration during the printing operation is based on at least environmental humidity.

11. A driving waveform generating device for an ink-jet recording head as claimed in one of claims 1–2, wherein the signal amplification means includes an amplifier circuit including a pair of transistors whose mutual emitters are connected together, and fixed resistors for always applying a predetermined voltage between the base•emitter to make the pair of transistors operate in an active area; and a negative resistor element having the same resistance value as that the fixed resistor is connected in parallel to by-pass the fixed resistor at a reference temperature before the pair of transistors self-generate heat so as to decrease the voltage between the base•emitter when the voltage between the base•emitter rises because of the self-generation of heat on the part of the pair of transistors.

12. A driving waveform generating device for an ink-jet recording head as claimed in claim 11, wherein the negative resistor element is a thermistor.

13. A driving waveform generating device for an ink-jet recording head, the driving waveform generating device comprising:

waveform generating means for generating a predetermined driving waveform for driving a recording head; and waveform amplifying means for amplifying the driving waveform generated by the waveform generating means and applying the driving waveform thus generated thereby to the recording head, said amplification means including:

an amplifier circuit including a pair of transistors whose mutual emitters are connected together;

fixed resistors for always applying a predetermined voltage between the base•emitter to make the pair of transistors operate in an active area; and a negative resistor element having the same resistance value as that of the fixed resistor connected in parallel to by-pass the fixed resistor at a reference temperature before the pair of transistors heat so as to decrease the voltage between the base•emitter when the voltage between the base•emitter rises because of the self-generation of heat on the part of the pair of transistors.

14. A driving waveform generating method for an ink-jet recording head, the driving waveform generating method for generating at least one presumed driving waveform in order to drive the recording head according to gradation data by utilization the driving waveform, comprising the steps of:

retaining a group of coordinate date for generating the driving waveform in waveform data means beforehand;

selecting one utilizing driving waveform from the driving waveforms and reading the group of coordinate data for the driving waveform from the waveform data storage means through waveform data read means;

creating the driving waveform by interpolating point-to-point values into the group of coordinate data read by the waveform data read means using the waveform data interpolation means;

subjecting the data on the driving waveform created by the waveform data interpolation means to digital/analog conversion using digital/analog conversion means in order to output an analog signal; and amplifying the analog signal output from the digital/analog conversion means using signal amplification means.

15. A driving waveform generating method for an ink-jet recording head as claimed in claim 14, further comprising:

correcting the driving waveform read by the waveform data read means in consideration of ink condition during a printing operation based on at least environmental temperatures.

16. A driving waveform generating method for an ink-jet recording head as claimed in claim 15, wherein said correcting step includes the following steps:

detecting the present temperature using a temperature detection unit;

calculating the difference between a predetermined temperature and the present environmental temperature based on the basic waveform of the predetermined temperature;

generating a waveform fit for the present temperature based on the difference therebetween; and;

outputting the waveform thus generated, wherein the above steps are performed for every page.

17. A driving waveform generating device for an ink-jet recording head, the driving waveform generating device generating at least one presumed driving waveform in order to drive the recording head according to gradation data by utilizing the driving waveform, the driving waveform generating device comprising:

waveform data storage means having a group of data on partial waveforms for generating the driving waveform;

waveform data generating means for selecting a plurality of partial waveforms out of the group of data on the partial waveforms in order to create the driving waveform by combining the plurality of partial waveforms;

digital/analog conversion means for subjecting data on the driving waveform created by the waveform data generating means to digital/analog conversion in order to output an analog signal; and signal amplification means for amplifying the analog signal which has been output from the digital/analog conversion means.

18. The method as set forth in claim 16, wherein the amplitude of the waveform fit is a function of said difference.

19. The method as set forth in claim 18, wherein said amplitude is reduced when said environmental temperature is higher than said predetermined temperature and said amplitude is increased when said environmental is lower than said predetermined temperature.

20. A driving waveform generating device for an ink-jet recording head, the driving waveform generating device generating at least one presumed driving waveform in order to drive the recording head according to gradation data by utilizing the driving waveform, the driving waveform generating device comprising:

waveform data storage memory having a group of waveform data for generating the driving waveform;

waveform data read unit for selecting at least one utilizing waveform data from the group of waveform data and reading the selected waveform data;

waveform data generator for performing a required arithmetic process on the waveform data read by the waveform data read unit in order to create driving waveforms;

digital/analog converter for subjecting data on the driving waveform created by the waveform data generator to digital/analog conversion in order to output an analog signal; and signal amplifier for amplifying the analog signal which has been output from the digital/analog converter.

21. A driving waveform generating device for an ink-jet recording head, the driving waveform generating device generating at least one presumed driving waveform in order to drive the recording head according to gradation data by utilizing the driving waveform, the driving waveform generating device comprising:

waveform data storage memory having a group of coordinate data for generating the driving waveform;

waveform data read unit for selecting at least one utilizing waveform data from the waveforms and reading the group of coordinate data for the driving waveform;

waveform data interpolation circuit for creating the driving waveform by interpolating point-to-point values into the group of coordinate data read by the waveform data read unit;

digital/analog converter for subjecting data on the driving waveform created by the waveform data interpolation circuit to digital/analog conversion in order to output an analog signal; and signal amplifier for amplifying the analog signal which has been output from the digital/analog converter.

22. A driving waveform generating device for an ink-jet recording head, the driving waveform generating device comprising:

waveform generator for generating a predetermined driving waveform for driving a recording head;

waveform amplifier for amplifying the driving waveform generated by the waveform generator and applying the driving waveform thus generated thereby to the recording head, said amplifier including;

an amplifier circuit including a pair of transistors whose mutual emitters are connected together;

fixed resistors for always applying a predetermined voltage between the base emitter to make the pair of transistors operate in an active area; and a negative resistor element having the same resistance value as that of a fixed resistor connected in parallel to by-pass the fixed resistor at a reference temperature before the pair of transistors so as to decrease the voltage between the base emitter when the voltage between the base emitter rises because of the self-generation of heat on the part of the pair of transistors.

23. A driving waveform generating device for an ink-jet recording head, the driving waveform generating device generating at least one presumed driving waveform in order to drive the recording head according to gradation data by utilizing the driving waveform, the driving waveform generating device comprising;

waveform data storage memory having a group of data on partial waveforms for generating the driving waveform;

waveform data generator for selecting a plurality of partial waveforms out of the group of data on the partial waveforms in order to create the driving waveform by combining the plurality of partial waveforms;

digital/analog converter for subjecting data on the driving waveform created by the waveform data generator to digital/analog conversion in order to output an analog signal; and signal amplifier for amplifying the analog signal which has been output from the digital/analog converter.

* * * * *